US005513798A

United States Patent [19]

Tavor

[11] Patent Number: 5,513,798

[45] Date of Patent: May 7, 1996

[54] ATOMIZER

[76] Inventor: Elhanan Tavor, 14 Vered Street, Carmiel 20 100, Israel

[21] Appl. No.: 398,812

[22] Filed: Mar. 6, 1995

Related U.S. Application Data

[63] Continuation of Ser. No. 138,464, Oct. 15, 1993, abandoned.

[30] Foreign Application Priority Data

Aug. 8, 1993 [IL] Israel ..... 106616

[51] Int. Cl.[6] ..... B05B 7/04; B05B 17/04

[52] U.S. Cl. ..... 239/8; 239/405

[58] Field of Search ..... 239/11, 401, 403, 239/405, 406, 8, 472, 487, 489, 501

[56] References Cited

U.S. PATENT DOCUMENTS

| | | | |
|---|---|---|---|
| 1,136,115 | 4/1915 | Frost | 239/406 |
| 2,607,743 | 8/1952 | Hession, Jr. . | |
| 2,624,624 | 1/1953 | Kirschbaum | 239/403 |
| 2,984,421 | 5/1961 | Hession, Jr. | 239/403 |
| 3,200,535 | 8/1965 | Hession, Jr. . | |
| 3,215,351 | 11/1965 | Briggs | 239/406 |
| 3,310,466 | 3/1967 | Hession, Jr. . | |
| 3,443,760 | 5/1969 | Simmons | 239/403 |
| 3,474,970 | 10/1969 | Simmons et al. | 239/406 |
| 3,510,061 | 5/1970 | Peczeli et al. | 239/8 |
| 3,726,482 | 4/1973 | Heinrichs . | |
| 3,762,652 | 10/1973 | Huling . | |
| 3,804,333 | 4/1974 | Kramer et al. | 239/406 |
| 3,908,903 | 9/1975 | Burns, Jr. | 239/2 |
| 3,923,248 | 12/1975 | Cresswell | 239/113 |
| 3,980,233 | 9/1976 | Simmons et al. | 239/400 |
| 4,241,877 | 12/1980 | Hughes | 239/405 |
| 4,335,677 | 6/1982 | Nagata et al. | 118/306 |
| 4,341,530 | 7/1982 | Loth et al. | 48/73 |
| 4,347,982 | 9/1982 | Wright | 239/405 |
| 4,406,404 | 9/1983 | Horino et al. | 239/91 |
| 4,595,143 | 6/1986 | Simmons et al. | 239/406 |
| 4,773,596 | 9/1988 | Wright et al. | 239/400 |
| 4,834,343 | 5/1989 | Boyes | 261/79.2 |
| 4,943,704 | 7/1990 | Rabenau et al. | 219/275 |
| 4,946,101 | 8/1990 | Winheim | 239/8 |
| 5,020,723 | 6/1991 | Crist | 239/405 |
| 5,020,725 | 6/1991 | Waldrum | 239/154 |
| 5,044,559 | 9/1991 | Russell et al. | 239/406 |
| 5,059,357 | 10/1991 | Wolf et al. | 261/53 |
| 5,181,661 | 1/1993 | Wollard | 239/704 |
| 5,251,823 | 10/1993 | Joshi et al. | 239/406 |

FOREIGN PATENT DOCUMENTS

| | | |
|---|---|---|
| 0085583 | 2/1983 | European Pat. Off. . |
| 2120587 | 11/1972 | Germany . |
| 2321922 | 3/1974 | Germany . |
| 12548 | 9/1959 | Israel . |
| 51142/2 | 2/1980 | Israel . |
| 55155/2 | 7/1982 | Israel . |
| 894776 | 4/1962 | United Kingdom . |

*Primary Examiner*—Karen B. Merritt

*Attorney, Agent, or Firm*—Woodcock Washburn Kurtz Mackiewicz & Norris

[57] ABSTRACT

An atomizer comprising a liquid inlet, a gas inlet arranged to receive a pressurized flow of gas, a liquid flowpath extending from the liquid inlet to a liquid stream outlet, and a curved gas flowpath extending from the gas inlet to a location adjacent the liquid stream outlet and including a supersonic flow region adjacent the liquid stream outlet, whereby supersonic gas flow adjacent the liquid stream outlet produces a shock wave which impinges on a liquid stream passing out through the liquid stream outlet for atomizing the liquid stream.

15 Claims, 5 Drawing Sheets

ATOMIZER

This is a continuation of application Ser. No. 08/138,464filed Oct. 15, 1993, now abandoned.

FIELD OF THE INVENTION

The present invention relates to atomizers generally.

BACKGROUND OF THE INVENTION

There are known in the art a great variety of atomizers. The following U.S. Pat. Nos. are considered to be representative of the most relevant prior art: 3,908,903; 3,980,233; 4,335,677; 4,341,530;. 4,406,404; 4,595,143; 4,773,596; 4,834,343; 4,943,704; 4,946,101; 5,044,559; 5,059,357; 5,181,661.

U.S. Pat. No. 4,341,530 describes a slurry atomizer wherein a pressurized helical flow of steam proceeds about a longitudinal axis, along which a liquid channel is defined. Impingement of the helical flow of stream on the liquid channel draws liquid through the channel and causes breakup of the resulting axial liquid flow into droplets.

SUMMARY OF THE INVENTION

The present invention seeks to provide an improved atomizer.

There is thus provided in accordance with a preferred embodiment of the present invention an atomizer comprising a liquid inlet, a gas inlet arranged to receive a pressurized flow of gas, a liquid flowpath extending from the liquid inlet to a liquid stream outlet, and a curved gas flowpath extending from the gas inlet to a location adjacent the liquid stream outlet and including a supersonic flow region adjacent the liquid stream outlet, whereby supersonic gas flow adjacent the liquid stream outlet produces a shock wave which impinges on a liquid stream passing out through the liquid stream outlet for atomizing the liquid stream.

In accordance with a preferred embodiment the curved gas flowpath comprises a generally helical flowpath.

Preferably, the generally helical flowpath extends about the liquid flowpath, which preferably is axial.

In accordance with a preferred embodiment of the present invention, the generally helical flowpath includes a truncated conical subsonic flow region upstream of and adjacent to the supersonic flow region.

There is also provided in accordance with a preferred embodiment of the present invention a method for atomizing comprising the steps of providing a pressurized flow of gas to a gas inlet and through a curved gas flowpath, providing a liquid flowpath extending from the liquid inlet to a liquid stream outlet and causing the pressurized flow of gas to undergo supersonic flow at a supersonic flow region adjacent the liquid stream outlet, thereby to produce a shock wave which impinges on a liquid stream passing out through the liquid stream outlet for atomizing the liquid stream.

In accordance with a preferred embodiment the gas passes along a generally helical flowpath.

Preferably, the generally helical flowpath extends about the liquid flowpath, which preferably is axial.

In accordance with a preferred embodiment of the present invention, the gas passes through a truncated conical subsonic flow region upstream of and adjacent to the supersonic flow region.

In accordance with a preferred embodiment of the present invention, the flow of the liquid stream is produced by suction resulting from the flow of gas.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
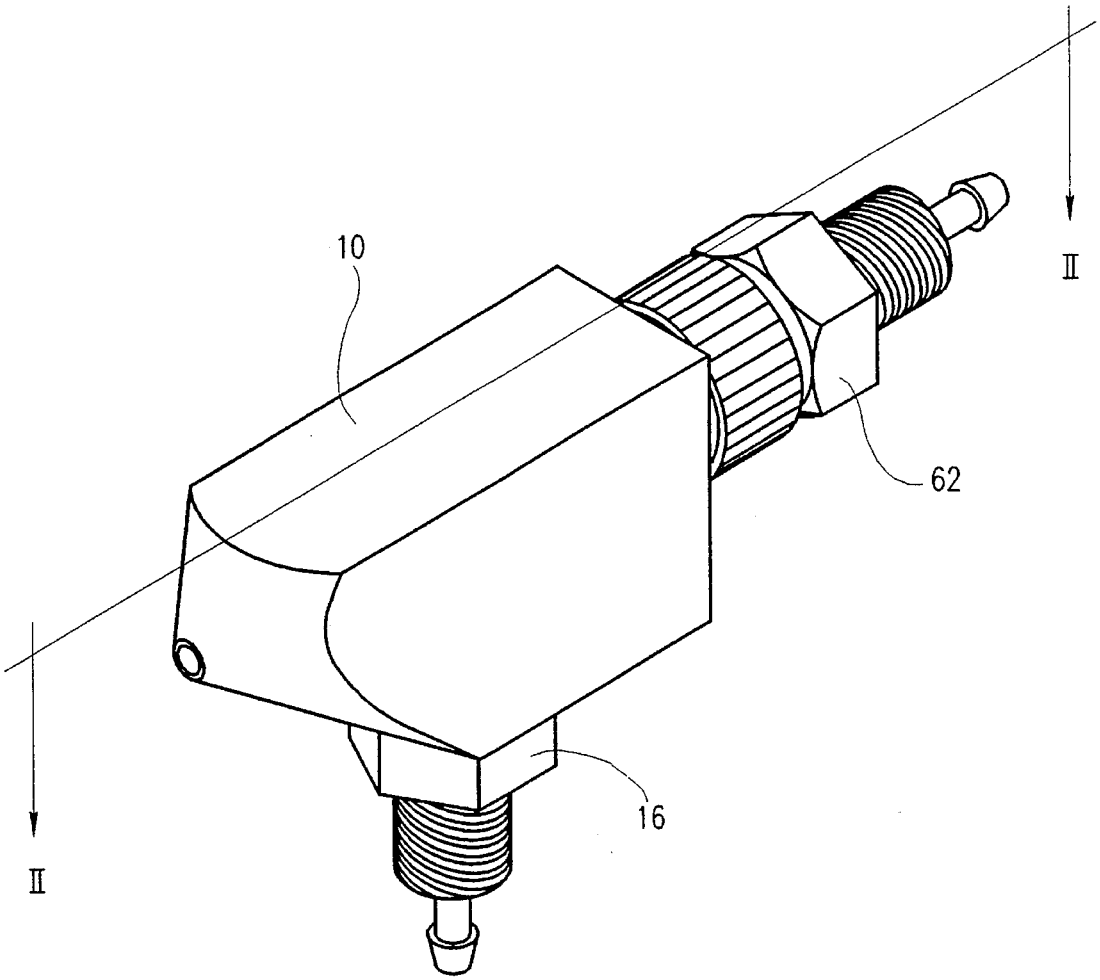
FIG. 1 is a pictorial illustration of atomizer apparatus constructed and operative in accordance with a preferred embodiment of the present invention.
Figure 2:
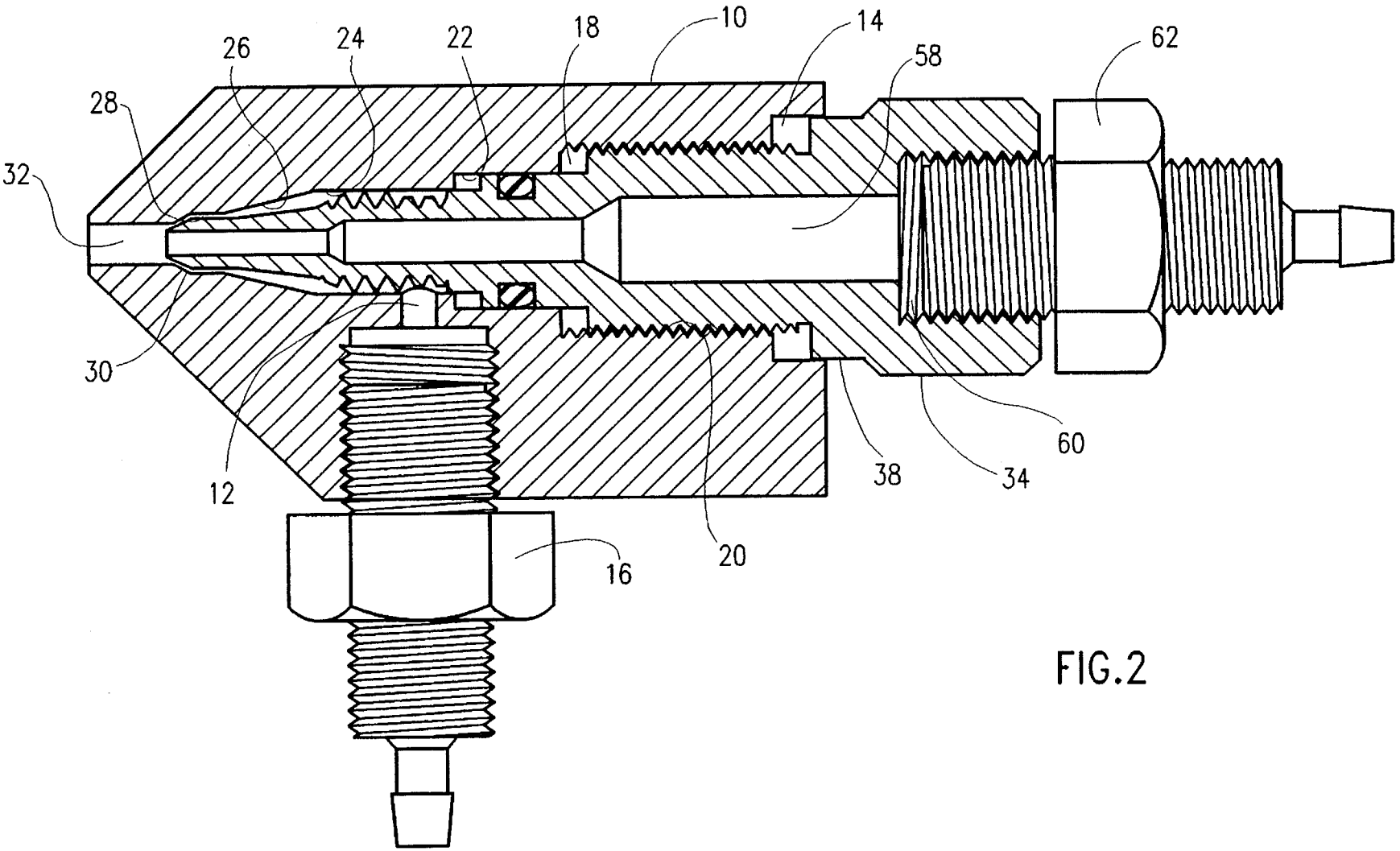
FIG. 2 is a sectional illustration taken along the lines II—II in FIG. 1.
Figure 3:
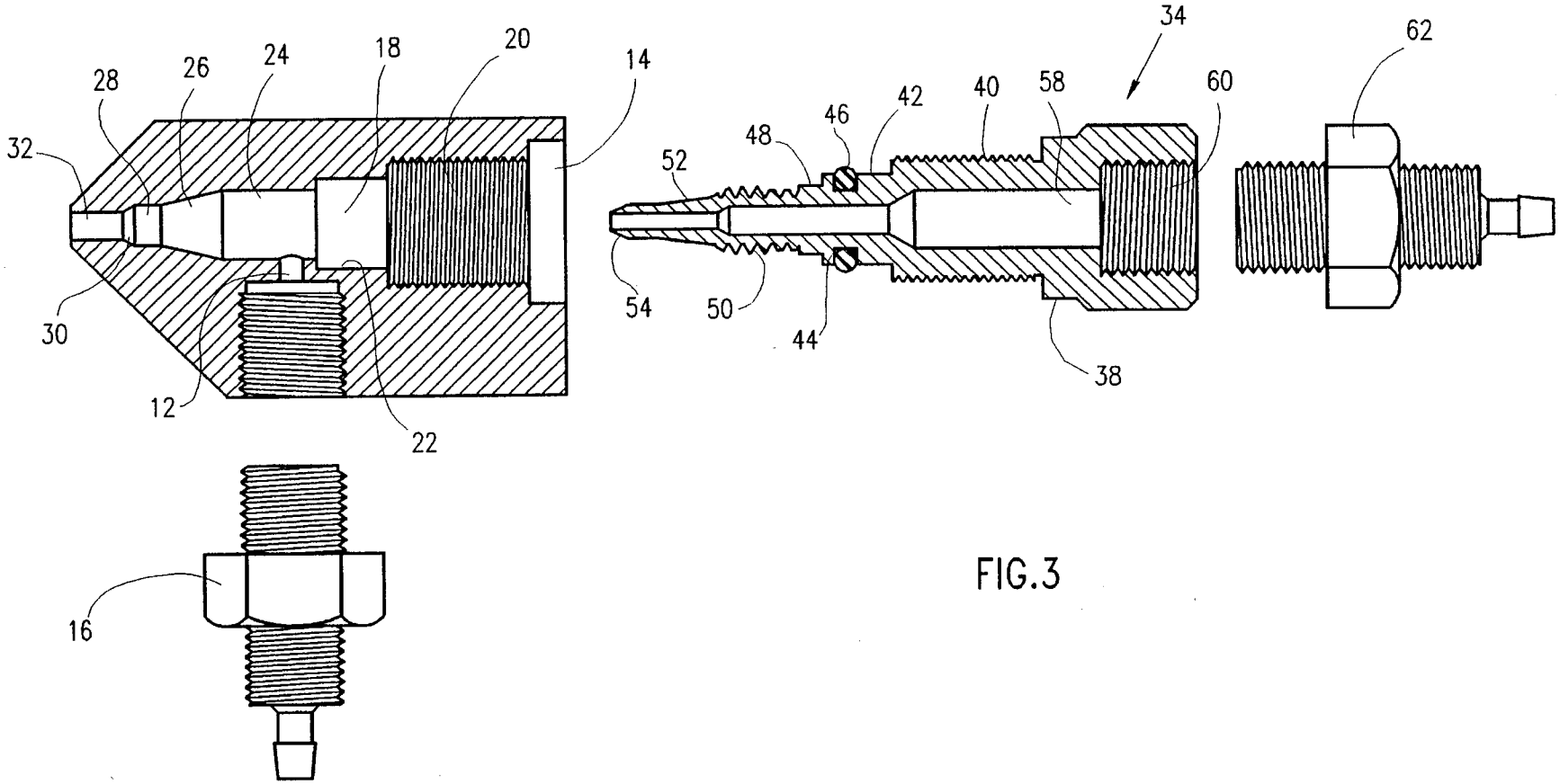
FIG. 3 is an exploded view sectional illustration of the apparatus of FIG. 2.
Figure 4:
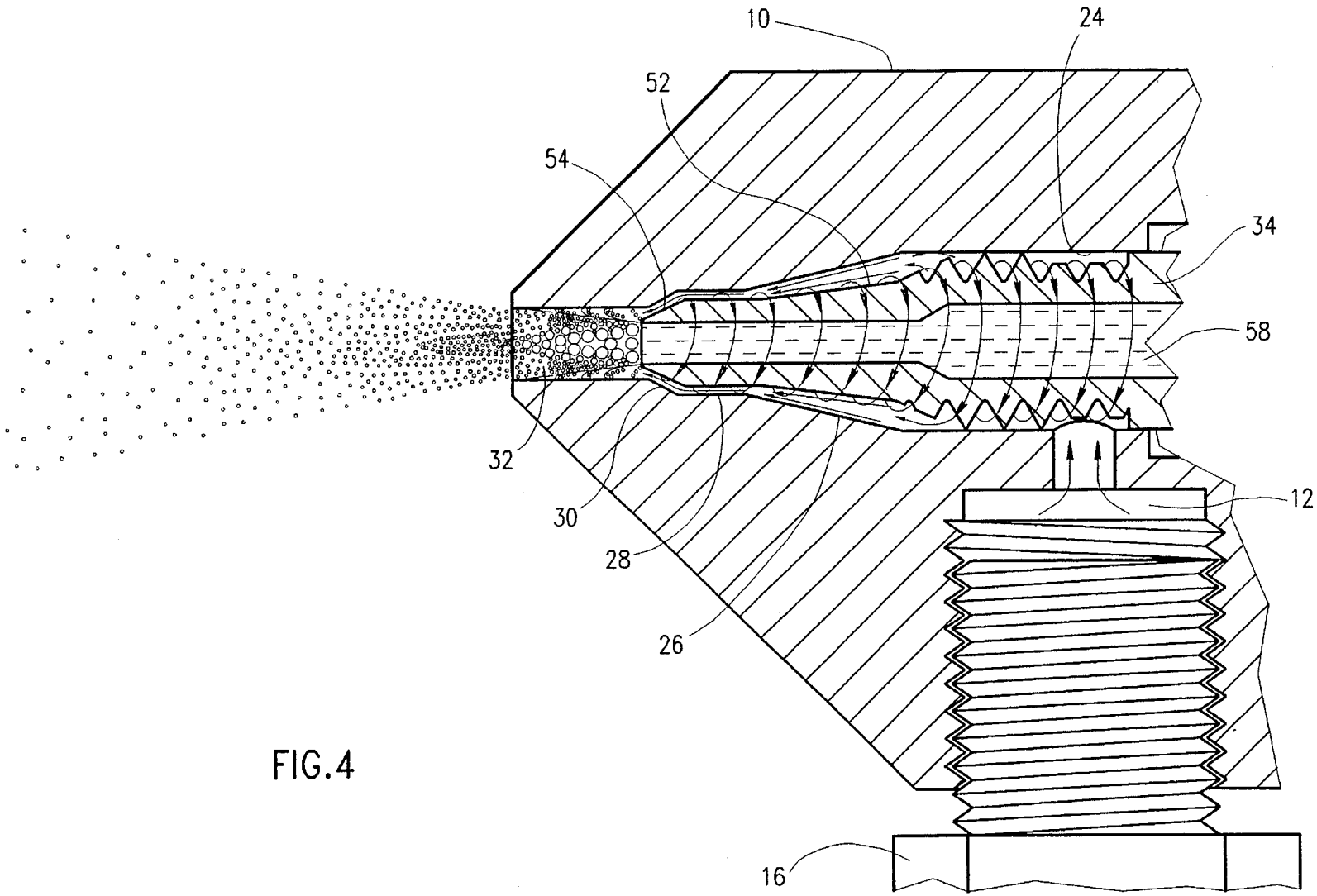
FIG. 4 is an enlarged illustration of part of the apparatus of FIGS. 2 and 3.

Reference is now made to FIGS. 1–5 which illustrate atomizing apparatus constructed and operative in accordance with a preferred embodiment of the present invention. The atomizing apparatus of the invention preferably comprises a housing 10 defining a pressurized gas inlet opening 12 and a liquid inlet opening 14. Pressurized gas inlet opening 12 is preferably threaded so as to sealingly accept a suitably threaded pressurized gas nipple assembly 16, through which pressurized gas, such as air under a pressure in the range of 5.5–6.5 atmospheres, is supplied to the housing 10. Alternatively a different inlet arrangement may be provided.

Liquid inlet opening 14 preferably communicates with a multiple stepped axial bore 18 which communicates with pressurized gas inlet opening 12. Multiple stepped axial bore 18 includes a threaded portion 20, adjacent inlet 14, followed by a narrowed intermediate portion 22. Portion 22 is followed by a further narrowed intermediate portion 24, which communicates with inlet 12. Intermediate portion 24 is followed by a tapered down portion 26, which, in turn, is followed by a yet further narrowed portion 28. Portion 28 is followed by another tapered portion 30, which is followed by an elongate outlet portion 32.

A liquid inlet pathway defining member 34 is threadably engaged in bore 18 and includes an inlet portion 38, which is located adjacent inlet 14. Member 34 also includes a threaded portion 40, which engages threaded bore portion 20, followed by a narrowed intermediate portion 42, which is formed with a recess 44 which accommodates a sealing ring 46. Portion 42 is followed by a further narrowed intermediate portion 48, which is followed by a grooved helical gas pathway defining portion 50, communicating with gas inlet 12. Portion 50 is followed by a slightly tapered portion 52, which terminates in a sharply tapered end portion 54.

Figure 5:
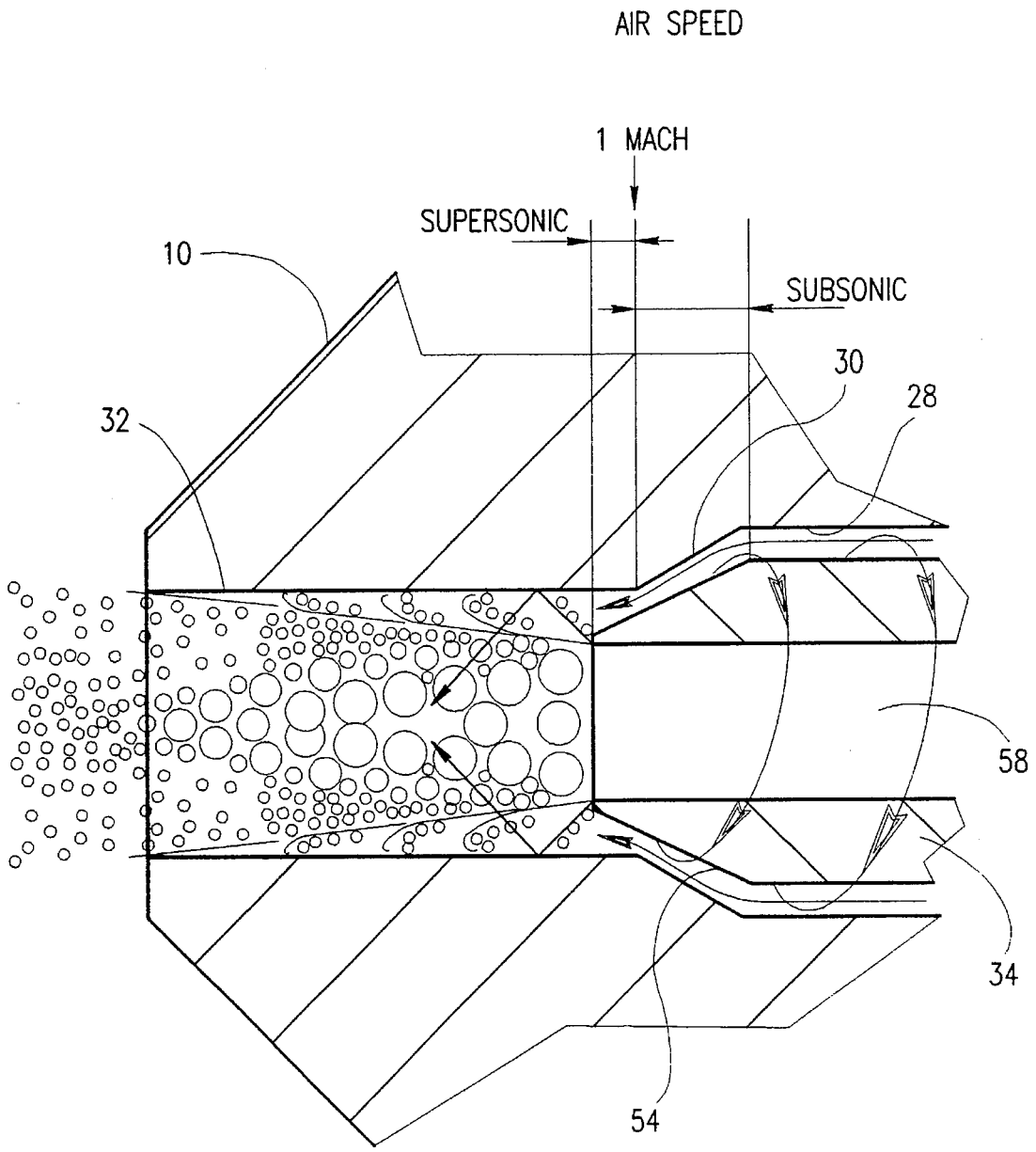
FIG. 5 is a further enlarged illustration of part of the apparatus of FIGS. 2 and 3.

It can be seen particularly from a consideration of FIG. 5, that the sharply tapered end portion 54 of member 34 lies adjacent tapered bore portion 30 and elongate outlet bore portion 32. The junction of the tapered bore portion 30 and of the outlet bore portion 32 defines the boundary between subsonic and supersonic gas flow regions.

Liquid flows through a successively narrowing bore 58 in member 34 from a threaded liquid inlet 60 which receives a liquid inlet nipple assembly 62 to an outlet adjacent end portion 54 and elongate outlet bore portion 32. The tangential component of the gas flow adjacent the liquid flow, draws the liquid flow through bore 58 from a liquid supply which may be unpressurized. Shock waves generated by supersonic flow of gas in the region between end portion 54 of member 34 and elongate outlet bore portion 32 of housing 10 impinge obliquely on the liquid flow and produce atomization thereof.

It is a feature of the invention that the substantial tangential gas flow creates a significant vacuum drawing the liquid into supersonic atomizing engagement therewith. The relatively high vacuum which is realized using the present invention is believed to significantly enhance its atomizing efficiency, inter alia due to a high level of evaporation resulting therefrom.

In practice, the following results have been obtained using the apparatus described above and illustrated in FIGS. 1–5:

Gas flow rate: 50–60 liter/min –1.76 cfm –2.12 cfm

Gas inlet pressure: 6 Bar

Liquid flow rate: 5.5–6 liter/hour

Output liquid drop size (mean): 2–10 microns

Vacuum level: 6–7 m water WG

Evaporation: approximately 10% of the water

It will be appreciated by persons skilled in the art that the present invention is not limited by what has been particularly shown and described hereinabove. Rather the scope of the present invention is defined only by the claims which follow:

I claim:

1. An atomizer comprising:

a liquid inlet;

a gas inlet arranged to receive a pressurized flow of gas;

a liquid flowpath extending from the liquid inlet to a liquid stream outlet;

a generally helical gas flowpath extending from the gas inlet to a location adjacent the liquid stream outlet and including a supersonic flow region adjacent the liquid stream outlet and an elongate, generally cylindrical, atomizing flowpath region downstream of the supersonic flow region and extending to an atomizer outlet, whereby supersonic gas flow adjacent the liquid stream outlet produces a shock wave at least partially reflected from a cylindrical wall of said elongate flowpath, which impinges obliquely on a liquid stream passing out through the liquid stream outlet for atomizing the liquid stream in the atomizing flowpath region.

2. Apparatus according to claim 1 and wherein the generally helical gas flowpath extends about the liquid flowpath.

3. Apparatus according to claim 2 and wherein said liquid flowpath is axial.

4. Apparatus according to claim 2 and wherein said generally helical gas flowpath includes a truncated conical subsonic flow region upstream of and adjacent to the supersonic flow region.

5. Apparatus according to claim 1 and wherein said liquid flowpath is axial.

6. Apparatus according to claim 1 and wherein said generally helical gas flowpath includes a truncated conical subsonic flow region upstream of and adjacent to the supersonic flow region.

7. Apparatus according to claim 1 and wherein said generally helical gas flowpath includes a truncated conical subsonic flow region upstream of and adjacent to the supersonic flow region.

8. Apparatus according to claim 1 and wherein said liquid stream is drawn along said liquid flowpath from said liquid inlet to said liquid stream outlet by a vacuum produced by said pressurized flow of gas tangential to said liquid.

9. A method for atomizing comprising the steps of:

providing a pressurized flow of gas to a gas inlet and through a generally helical gas flowpath;

providing a liquid flowpath extending from a liquid inlet to a liquid stream outlet;

causing the pressurized flow of gas to undergo supersonic flow at a supersonic flow region adjacent the liquid stream outlet, thereby to produce a shock wave, at least partially reflected from a cylindrical wall of said elongate flowpath, which impinges obliquely on a liquid stream at an elongate, generally cylindrical, atomizing flowpath region downstream of the supersonic flow region extending to an atomizer outlet for atomizing the liquid stream in the atomizing flowpath region.

10. A method according to claim 9 and wherein said liquid flowpath is axial and said generally helical gas flowpath extends about the liquid flowpath.

11. A method according to claim 10 and wherein the flow of the liquid stream is produced by suction resulting from the flow of gas.

12. A method according to claim 9 and wherein the gas passes through a truncated conical subsonic flow region upstream of and adjacent to the supersonic flow region.

13. A method according to claim 12 and wherein the flow of the liquid stream is produced by suction resulting from the flow of gas.

14. A method according to claim 9 and wherein the flow of the liquid stream is produced by suction resulting from the flow of gas.

15. The method according to claim 9 and wherein said liquid stream is drawn along said liquid flowpath from said liquid inlet to said liquid stream outlet by a vacuum produced by said pressurized gas flow tangential to said liquid.

* * * * *